US008827103B1

(12) United States Patent
Engstrom

(10) Patent No.: US 8,827,103 B1
(45) Date of Patent: Sep. 9, 2014

(54) TRASH CAN FORMED WITH SIDEWALL ENGAGEMENTS

(71) Applicant: James A. Engstrom, Scottsdale, AZ (US)

(72) Inventor: James A. Engstrom, Scottsdale, AZ (US)

( * ) Notice: Subject to any disclaimer, the term of this patent is extended or adjusted under 35 U.S.C. 154(b) by 0 days.

(21) Appl. No.: 13/951,927

(22) Filed: Jul. 26, 2013

(51) Int. Cl.
*B65F 1/06* (2006.01)

(52) U.S. Cl.
CPC ..... *B65F 1/06* (2013.01)
USPC ..... 220/495.08; 220/495.06

(58) Field of Classification Search
CPC ..... B65F 1/067; B65F 1/06; B65F 1/04; B65D 25/30; B65D 5/60; B65D 5/4608; B65D 5/46072; B65D 5/46
USPC ..... 220/495.11, 495.09, 495.08, 495.07, 220/495.06, 495.01, 676, 6, 4.28, 770, 771, 220/908.1, 908; 229/117.35, 117.34, 229/117.33, 117.27, 117.16, 117.13, 229/117.12; 206/485, 756, 757, 763, 784
See application file for complete search history.

(56) References Cited

U.S. PATENT DOCUMENTS

| | | | | | |
|---|---|---|---|---|---|
| 1,955,385 | A | * | 4/1934 | Gray | 220/495.11 |
| 2,324,440 | A | * | 7/1943 | Tormohlen | 220/495.07 |
| 3,384,228 | A | * | 5/1968 | Cannon | 206/485 |
| 4,576,310 | A | * | 3/1986 | Isgar et al. | 220/495.1 |
| 5,419,452 | A | * | 5/1995 | Mueller et al. | 220/495.08 |
| 5,636,416 | A | | 6/1997 | Anderson | |
| 5,645,186 | A | * | 7/1997 | Powers et al. | 220/495.11 |
| 6,102,239 | A | * | 8/2000 | Wien | 220/495.07 |
| D490,581 | S | | 5/2004 | Keithly et al. | |
| 7,243,811 | B1 | | 7/2007 | Ramsey | |
| D580,616 | S | | 11/2008 | Bizzell et al. | |
| D584,470 | S | | 1/2009 | Bizzell et al. | |
| D611,217 | S | | 3/2010 | Bizzell et al. | |
| 8,061,546 | B2 | | 11/2011 | Ramsey | |
| 2002/0096524 | A1 | | 7/2002 | Hardesty | |
| 2003/0089719 | A1 | | 5/2003 | Berger | |

* cited by examiner

*Primary Examiner* — Robert J Hicks

(74) *Attorney, Agent, or Firm* — Thomas W. Galvani, P.C.; Thomas W. Galvani

(57) ABSTRACT

A receptacle includes a base panel and a sidewall having first and second sets of opposed side panels. First and second retention assemblies are formed through the first and second sets of side panels, and the first retention assembly is vertically offset from the second retention assembly. The first and second retention assemblies each include a plurality of tiered engagements, which engagements have a hole and a rigid finger projecting downwardly into the hole. Bags are applied to the receptacle and retained by the engagements in a tiered, nested fashion. The receptacle is collapsible from an assembled condition to a disassembled condition or a storage condition.

17 Claims, 6 Drawing Sheets

TRASH CAN FORMED WITH SIDEWALL ENGAGEMENTS

FIELD OF THE INVENTION

The present invention relates generally to trash cans, and more particularly to environmentally friendly trash cans.

BACKGROUND OF THE INVENTION

Americans produce a large amount of trash. Recent studies by the Environmental Protection Agency estimate that each person in America produces an average of 4.5 pounds of solid waste trash every single day, equating to over a billion collective pounds of trash in the country. This staggering amount of trash is an environmental issue, and efforts to reduce, reuse, and recycle are vitally important to maintaining the quality of our environment.

While some of the trash produced is degradable or compostable, much of the trash is not readily biodegradable or photodegradable, and as such, can persist for thousands of years before it has degraded or decomposed. One particular scourge is the plastic bag. Plastic bags are extremely thin bags, frequently made from polyethylene, often distributed by stores to customers to carry purchases home. The bags are generally intended to be single-use; when the customer arrives home, he or she will remove the purchased items from the bag and then throw the bag away.

Most bags distributed at grocery stores are plastic bags, generally known as grocery bags, or also as t-shirt bags because of their similar appearance to an A-shirt or sleeveless undershirt. Grocers provide these bags to their shoppers to carry purchased groceries home. Grocers are generous with their bags: meats are placed in separate bags from other items, cold items are double bagged, sometimes a separate bag will be used as a handle to carry the other bags. These bags are useful for carrying and containing the groceries on the trip home. Once home, their usefulness generally ends. Most shoppers discard the bags. A small number of municipalities providing recycling for grocery bags, leaving shoppers with the choice of either discarding the bags or storing them for mass recycling with a private organization. Estimates range from between one to five percent of grocery bags are recycled.

When viewed against the relatively short useful life of these single-use plastic bags, there is a tremendous energy cost in manufacturing and shipping a bag, and there is a huge environmental impact. The United States uses approximately one hundred billion plastic bags each year and discards approximately three million tons of plastic bags. Plastic bags rank as the second most common form of trash after cigarette butts, and the United Nations has estimated that each square mile of the ocean contains about 46,000 pieces of floating plastic. Over one million marine birds and animals die each year from ingestion of plastic bags.

Solutions to the plastic bag problem are needed. Increasing the number of ways a person can reduce, reuse, and recycle a plastic bag would greatly contribute to the preservation of the environment.

SUMMARY OF THE INVENTION

According to the principle of the invention, a receptacle for holding plastic grocery bags is formed with retention assemblies for holding handles of the grocery bags. Plastic grocery bags can be reused in the receptacle after their initial use by retaining the handles in the retention assemblies and placing the bags in the receptacle to hold trash and waste.

The receptacle has a sidewall including first and second sets of opposed side panels, and the retention assemblies include first and second sets of engagements formed through the sidewall in the first and second sets of opposed side panels. Each engagement includes a hole and a finger projecting downward into the hole. Each finger is a rigid and integral extension of the sidewall. The sidewall is also formed with at least one port underneath the engagements, and when bags are applied to the receptacle, the lower-most bag defines a void between the lower-most bag and the bottom of the receptacle which is accessible by the port. Spare bags are placed and stored in the void for storage and later use.

BRIEF DESCRIPTION OF THE DRAWINGS

Referring to the drawings.

DETAILED DESCRIPTION

Figure 1:
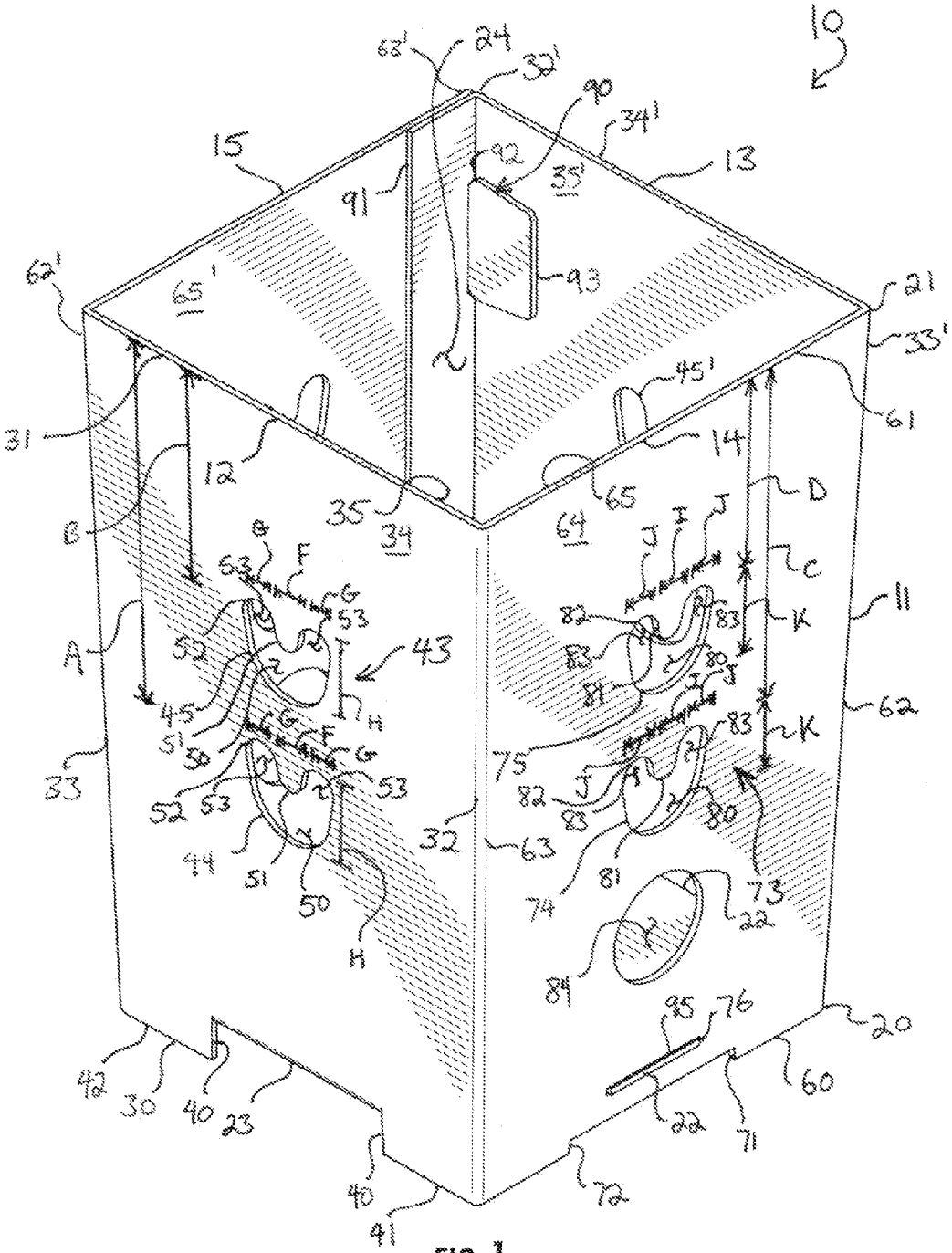
FIG. 1 is a top perspective view of a trash can, constructed and arranged according to the principle of the invention in an assembled condition, and including front, rear, right, and left panels and a bottom panel.

Reference now is made to the drawings, in which the same reference characters are used throughout the different figures to designate the same elements. FIG. 1 illustrates a receptacle 10 constructed and arranged according to the principle of the invention, having a sidewall 11 formed from two sets of opposed side panels. As a matter of clarity, a first set of opposed side panels is identified here as including a front side panel, or simply a front panel 12, and an opposed rear side panel, or simply a rear panel 13. A second set of opposed side panels is identified as including a right side panel, or simply a right panel 14, and an opposed left side panel, or simply a left panel 15. When the rear panel 13 and the left panel 15 are coupled to each other, the front, rear, right, and left panels 12, 13, 14, and 15 cooperate to define the continuous sidewall 11 of the receptacle 10 which extends from a bottom 20 of the receptacle 10 to an opposed top 21 of the receptacle 10. Each of the front, rear, right, and left panels 12, 13, 14, and 15 also extend from the bottom 20 to the top 21.

A base panel 22 is located proximate to the bottom 20 of the receptacle 10, and is mounted for pivotal movement along a living hinge 23 to the bottom 20 of the front panel 12. The base panel 22, together with the sidewall 11 and the top 21, bound and define an interior 24 of the receptacle 10 which is structured and arranged to hold trash within bags applied to the interior 24.

The sets of opposed side panels are similar in construction, but will be described separately for clarity. The first set of opposed side panels, consisting of the front and rear panels 12 and 13 will be discussed first. Still referring to FIG. 1, the front and rear panels 12 and 13 are coextensive and nearly identical in shape. The front panel 12 includes a bottom 30 located at the bottom 20 of the receptacle 10, a top 31 located at the top 21 of the receptacle 10, and opposed side edges 32 and 33. The front panel 12 has an outer face 34 and an opposed inner face 35, which are close to each other, since the front panel 12 has a relatively thin thickness between the outer and inner faces 34 and 35.

The base panel 22 is attached to the bottom 30 of the front panel 12. Two spaced-apart slits 40 extend upward from the bottom 30 between the side edges 32 and 33, and the living hinge 23 is formed just above the bottom 30 between the slits 40. The living hinge 23, spaced just above the bottom 30, forms a void which separates and defines two feet 41 and 42 at the bottom of the front panel 12. The feet 41 and 42 are rectangular projections extending downward from and contiguous to the front panel 12. The foot 41 extends and wraps around to the right panel 14, and the foot 42 extends and wraps around to the left panel 15.

The front panel is formed with a retention assembly 43, including two engagements 44 and 45. The engagements 44 and 45 are formed near a center of the front panel 12, at a location intermediate with respect to the side edges 32 and 33 and generally intermediate between the bottom 30 and top 31. The engagements 44 and 45 are tiered, such that the engagements 44 and 45 are vertically aligned and the engagement 44 is directly below the engagement 45. Further, the engagements 44 and 45 are each vertically aligned with the living hinge 23.

The engagements 44 and 45 are identical in structure, and as such, only the engagement 44 will be described with the understanding that the description applies equally to the engagement 45. The reference characters applied to the various structural elements and features of the engagement 44 are also used for the engagement 45. The engagement 44 includes a hole 50 formed through the front panel 12 from the outer face 34 to the inner face 35. The hole 50 is generally U-shaped, with a finger 51 projecting downward into the hole 50 from a top 52 of the hole 50. The finger 51 is a projection of the front panel 12 into the hole 50, integrally and rigidly formed with the sidewall 11 as a continuous extension thereof. As a rigid extension of the sidewall 11, the finger 51 resists flexing away from the sidewall 11, into and out of the inner and outer faces 34 and 35. The finger 51 bifurcates the top 52 of the hole 50, defining two opposed gaps 53 formed on either side of the finger 51. The finger 51 extends into the hole 50 a distance approximately equal to one-third of a height H of the hole 50, and each of the gaps 53 has a width G which is approximately the same as a width F of the finger 51, as shown in FIG. 1. The top 52 of the engagement 44 is spaced below the top 31 of the front panel 12 by a distance A, and the top 52 of the engagement 45 is spaced below the top 31 by a distance B.

As stated above, the front and rear panels 12 and 13 are similar in construction and are coextensive and nearly identical in shape. As such, the reference characters used to describe the front panel 12 are also used to describe the rear panel 13, but are designated with a prime ("") symbol to differentiate the various structural features and elements of the rear panel 13 from those of the front panel 12. The rear panel 13 is partially shown in FIG. 1, and is fully shown in elevation in FIG. 2. The rear panel 13 includes a bottom 30' located at the bottom 20 of the receptacle 10, a top 31' located at the top 21 of the receptacle 10, and opposed side edges 32' and 33'. The rear panel 13 has an outer face 34' and an opposed inner face 35', which are close to each other, since the rear panel 13 has a relatively thin thickness between the outer and inner faces 34' and 35'.

Two feet 41' and 42' are formed at the bottom 30' of the rear panel 13. The feet 41' and 42' are rectangular projections extending downward from and contiguous to the rear panel 13. The foot 41' wraps around to the left panel 15, and the foot 42' wraps around to the right panel 14. A slot 46 is formed above the bottom 30', between the feet 41' and 42', spaced apart from the bottom 30', and extending parallel to the bottom 30'. The slot 46 has a height slightly greater than the thickness of the sidewall 11. The slot 46 receives a tab of the base panel 22 to lock the base panel 22 into the rear panel 13. The rear panel 13 is formed with a retention assembly 43' which includes two engagements 44' and 45'. This retention assembly 43' is complemental to the retention assembly 43 formed in the front panel 12, forming two sets of engagements 44 and 44', and 45 and 45', which are each useful to secure and hang a two-handled bag in the receptacle 10. The engagements 44 and 44' are parallel and directly across the receptacle from each other, and the engagements 45 and 45' are parallel and directly across the receptacle from each other. The engagements 44' and 45' are formed near a center of the rear panel 13, at a location intermediate with respect to the side edges 32' and 33' and generally intermediate between the bottom 30' and top 31'. The engagements 44' and 45' are tiered, such that the engagements 44' and 45' are vertically aligned and the engagement 44' is directly below the engagement 45'. Further, the engagements 44' and 45' are each vertically aligned with the slot 46.

Figure 2:
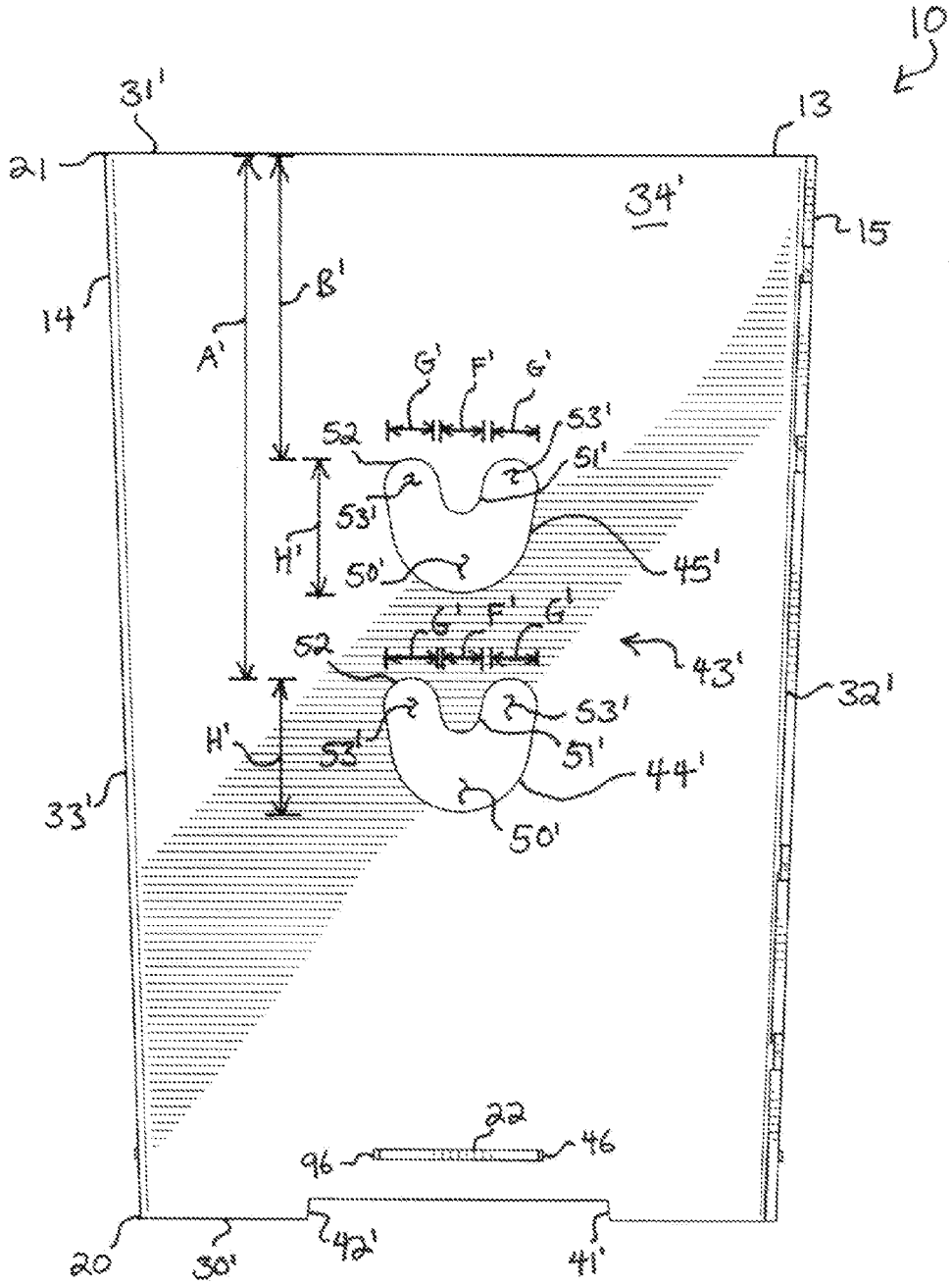
FIG. 2 is an elevation view of the rear panel of the trash can of FIG. 1.

The engagements 44' and 45' are identical in structure, and as such, only the engagement 44' will be described with the understanding that the description applies equally to the engagement 45'. The reference characters applied to the various structural elements and features of the engagement 44' are also used for the engagement 45'. The engagement 44' includes a hole 50' formed through the rear panel 13 from the outer face 34' to the inner face 35'. The hole 50' is generally U-shaped, with a finger 51' projecting downward into the hole 50' from a top 52' of the hole 50'. The finger 51' is a projection of the rear panel 13 into the hole 50', integrally and rigidly formed with the sidewall 11 as a continuous extension thereof. As a rigid extension of the sidewall 11, the finger 51' resists flexing into and out of the inner and outer faces 34' and 35'. The finger 51' bifurcates the top 52' of the hole 50', defining two opposed gaps 53' formed on either side of the finger 51'. The finger 51' extends into the hole 50' a distance approximately equal to one-third of a height H' of the hole 50', and each of the gaps 53' has a width G' which is approximately the same as a width F' of the finger 51', as shown in FIG. 2. The top 52' of the engagement 44' is spaced below the top 31' of the rear panel 13 by a distance A', and the top 52' of the engagement 45' is spaced below the top 31' by a distance B'. The distance A' is equal to the distance A, and the distance B' is equal to the distance B. As such, the engagement 44 is parallel to the engagement 44', and the engagement 45 is parallel to the engagement 45'.

The second set of opposed side panels, consisting of the right and left panels 14 and 15, will now be discussed. Referring again to FIG. 1, the right and left panels 14 and 15 are coextensive and nearly identical in size and shape. The right panel 14 includes a bottom 60 located at the bottom 20 of the receptacle 10, a top 61 located at the top 21 of the receptacle 10, and opposed side edges 62 and 63. The right panel 14 has an outer face 64 and an opposed inner face 65, which are close to each other, since the right panel 14 has a relatively thin thickness between the outer and inner faces 64 and 65.

Two feet 71 and 72 are formed at the bottom 60 of the right panel 14. The feet 71 and 72 are rectangular projections extending downward from and contiguous to the right panel 14. The foot 71 wraps around to the foot 42' on the rear panel 13, and the foot 72 wraps around to the foot 41 on the front panel 12. A slot 76 is formed above the bottom 60, between the feet 71 and 72, spaced apart from the bottom 60, and extending parallel to the bottom 60. The slot 76 has a height slightly greater than the thickness of the sidewall 11. The slot 76 receives a tab of the base panel 22 to lock the base panel 22 into the right panel 14.

The right panel 14 is formed with a retention assembly 73 which includes two engagements 74 and 75. The engagements 74 and 75 are formed near a center of the right panel 14, at a location intermediate with respect to the side edges 62 and 63 and generally intermediate between the bottom 60 and top 61. The engagements 74 and 75 are tiered, such that the engagements 74 and 75 are vertically aligned and the engagement 74 is directly below the engagement 75. Further, the engagements 74 and 75 are each vertically aligned with the slot 76.

The engagements 74 and 75 are identical in structure, and as such, only the engagement 74 will be described with the understanding that the description applies equally to the engagement 75. The reference characters applied to the various structural elements and features of the engagement 74 are also used for the engagement 75. The engagement 74 includes a hole 80 formed through the right panel 14 from the outer face 64 to the inner face 65. The hole 80 is generally U-shaped, with a finger 81 projecting downward into the hole 80 from a top 82 of the hole 80. The finger 81 is a projection of the right panel 14 into the hole 80, integrally and rigidly formed with the sidewall 11 as a continuous extension thereof. As a rigid extension of the sidewall 11, the finger 81 resists flexing into and out of the inner and outer faces 64 and 65. The finger 81 bifurcates the top 82 of the hole 80, defining two opposed, identical gaps 83 formed on either side of the finger 81. The finger 81 extends into the hole 80 a distance approximately equal to one-third of a height K of the hole 80, and each of the gaps 83 has a width J which is approximately the same as a width I of the finger 81, as shown in FIG. 1. The top 82 of the engagement 84 is spaced below the top 61 of the right panel 14 by a distance C, and the top 82 of the engagement 85 is spaced below the top 61 by a distance D. The distance C is less than the distance A, and the distance D is less than the distance B. In this way, the retention assembly 73 is vertically offset from the retention assembly 43, and similarly, the engagements 74 and 75 of the retention assembly 73 are vertically offset from the engagements 44 and 45 of the retention assembly 43.

A port 84 is formed through the right panel 14 from the outer face 64 to the inner face 65. The port 84 is circular and is vertically aligned with the engagements 74 and 75, intermediately between the side edges 62 and 63. The port 84 has the same width as the engagements 74 and 75 and as the slot 76. The port 84 is spaced generally intermediate with respect to the engagement 74 and the slot 76. The port 84 provides access into the interior 24 of the receptacle 10 proximate to the bottom 20.

As stated above, the right and left panels 14 and 15 are similar in construction and are coextensive and nearly identical in shape. As such, the reference characters used to describe the right panel 14 are also used to describe the left panel 15, but are designated with a prime ("") symbol to differentiate the various structural features and elements of the left panel 15 from those of the right panel 14. The left panel 15 is partially shown in FIG. 1, and is fully shown in elevation in FIG. 3.

The left panel 15 includes a bottom 60' located at the bottom 20 of the receptacle 10, a top 61' located at the top 21 of the receptacle 10, and opposed side edges 62' and 63'. The left panel 15 has an outer face 64' and an opposed inner face 65', which are close to each other, since the left panel 15 has a relatively thin thickness between the outer and inner faces 64' and 65'.

Two feet 71' and 72' are formed at the bottom 60' of the left panel 15. The feet 71' and 72' are rectangular projections extending downward from and contiguous to the left panel 15. The foot 71' wraps around to the foot 42 on the front panel 12, and the foot 72' wraps around to the foot 41' on the rear panel 13. A slot 76' is formed above the bottom 60', between the feet 71' and 72', spaced apart from the bottom 60', and extending parallel to the bottom 60'. The slot 76' has a height slightly greater than the thickness of the sidewall 11. The slot 76' receives a tab of the base panel 22 to lock the base panel 22 into the left panel 15.

The left panel 15 is formed with a retention assembly 73' which includes two engagements 74' and 75'. This retention assembly 73' is complemental to the retention assembly 73 formed in the right panel 14, forming two sets of engagements 74 and 74', and 75 and 75', which are each useful to secure and hang a two-handled bag in the receptacle 10. The engagements 74' and 75' are formed near a center of the left panel 15, at a location intermediate with respect to the side edges 62' and 63' and generally intermediate between the bottom 60' and top 61'. The engagements 74' and 75' are tiered, such that the engagements 74' and 75' are vertically aligned and the engagement 74' is directly below the engagement 75'. Further, the engagements 74' and 75' are each vertically aligned with the slot 76'.

Figure 3:
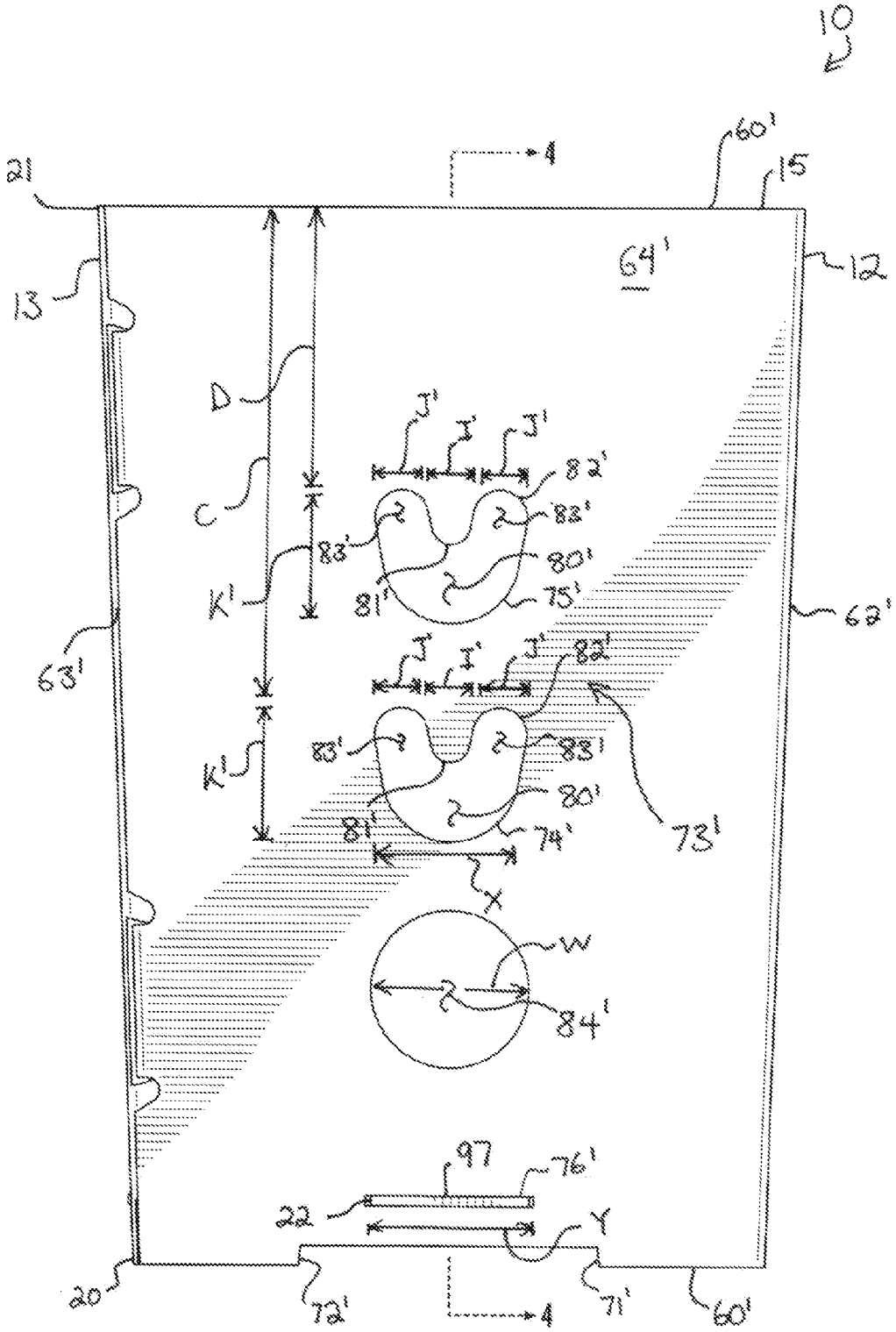
FIG. 3 is an elevation view of the left panel of the trash can of FIG. 1.

The engagements 74' and 75' are identical in structure, and as such, only the engagement 74' will be described with the understanding that the description applies equally to the engagement 75'. The reference characters applied to the various structural elements and features of the engagement 74' are also used for the engagement 75'. The engagement 74' includes a hole 80' formed through the left panel 15 from the outer face 64' to the inner face 65'. The hole 80' is generally U-shaped, with a finger 81' projecting downward into the hole 80' from a top 82' of the hole 80'. The finger 81' is a projection of the left panel 15 into the hole 80', integrally and rigidly formed with the sidewall 11 as a continuous extension thereof. As a rigid extension of the sidewall 11, the finger 81' resists flexing away from the sidewall 11, into and out of the inner and outer faces 64' and 65'. The finger 81' bifurcates the top 82' of the hole 80', defining two opposed, identical gaps 83' formed on either side of the finger 81'. The finger 81' extends into the hole 80' a distance approximately equal to one-third of a height K' of the hole 80', and each of the gaps 83' has a width J' which is approximately the same as a width I' of the finger 81', as shown in FIG. 3. The top 82' of the engagement 74' is spaced below the top 61' of the left panel 15 by a distance C', and the top 82' of the engagement 85' is spaced below the top 61' by a distance D'. The distance C' is equal to the distance C, which are each less than the distance A, and the distance D' is equal to the distance D, which are each less than the distance B. In this way, the retention assembly 73' is vertically offset from the retention assembly 43', and the engagements 74 and 75, and the engagements 74' and 75', of the retention assemblies 73 and 73', respectively, are vertically offset from the engagements 44 and 45, and the engagements 44' and 45', of the retention assemblies 43 and 43', respectively.

A port 84 is formed through the left panel 15 from the outer face 64' to the inner face 65'. The port 84' is circular and is vertically aligned with the engagements 74' and 75', intermediately between the side edges 62' and 63'. The port 84' has the same width as the engagements 74' and 75' and as the slot 76'. The port 84' has a width W which is equal to a width X of the engagements 74' and 75', and equal to a width Y of the slot 76'. The port 84' is spaced generally intermediate with respect to the engagement 74' and the slot 76'. The port 84' provides access into the interior 24 of the receptacle 10 proximate to the bottom 20.

Figure 4:
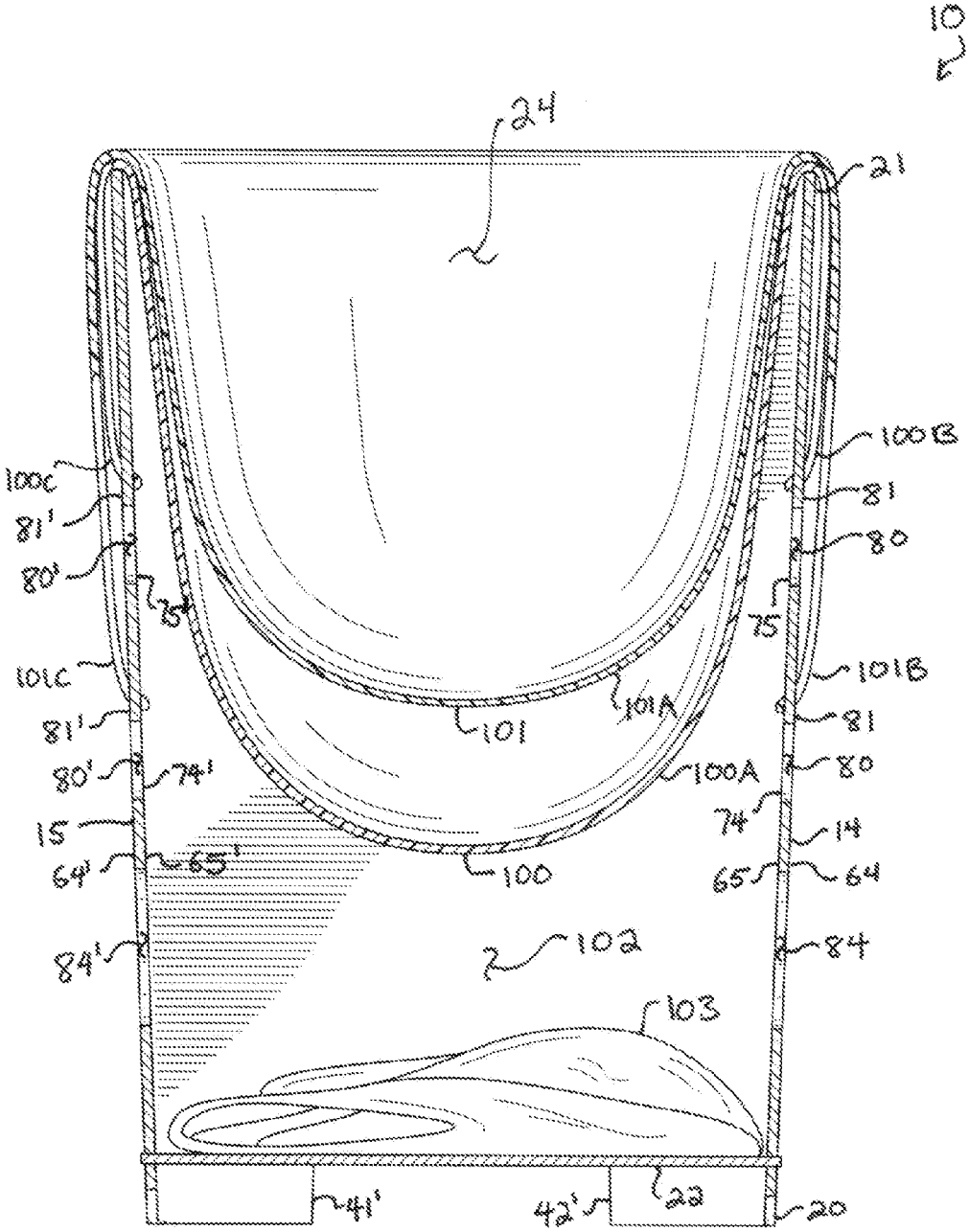
FIG. 4 is a section view taken along the line 4-4 in FIG. 3, showing bags applied to the trash can.
Figure 5:
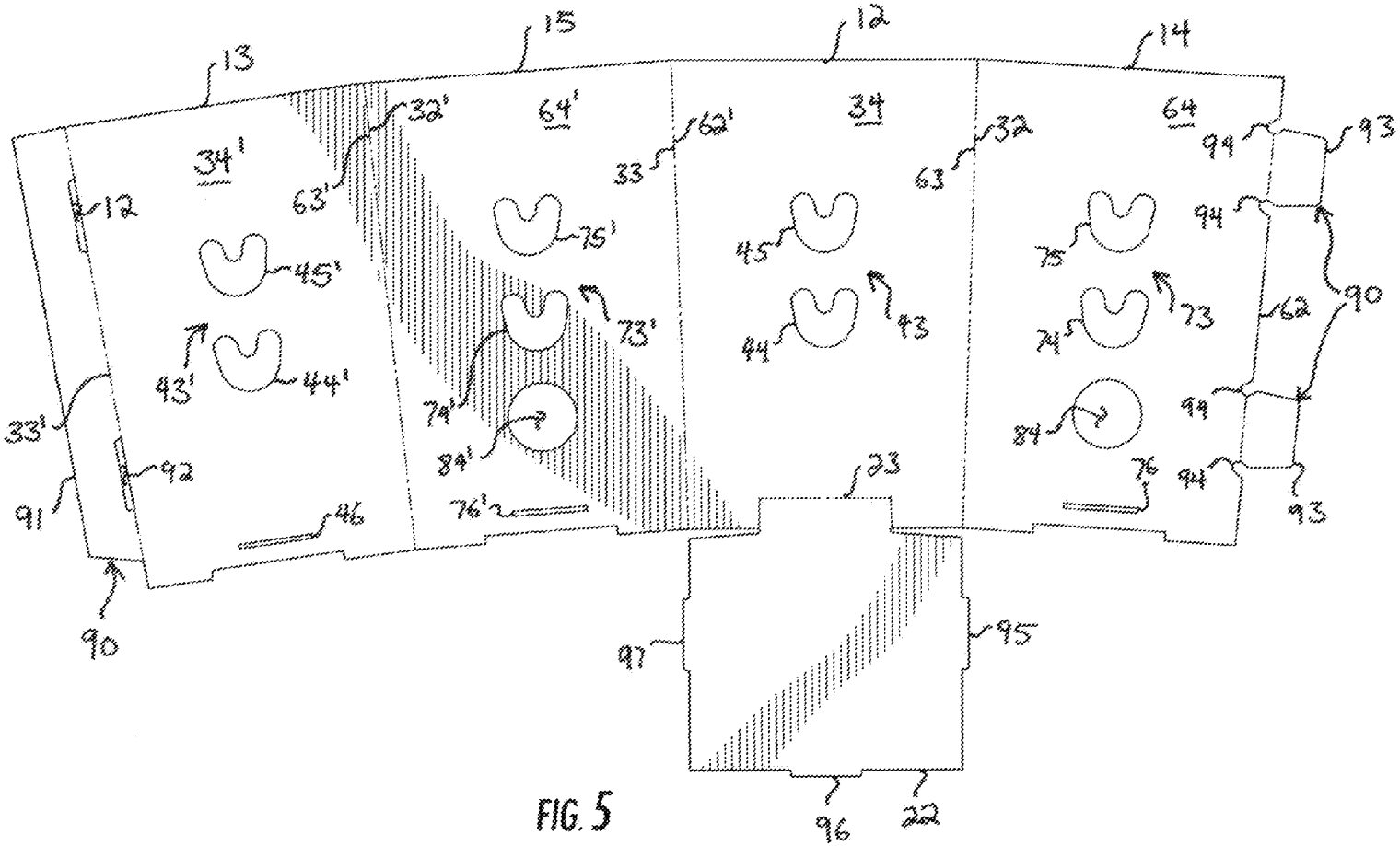
FIG. 5 is a top plan view of the trash can of FIG. 1, arranged in a disassembled condition.
Figure 6:
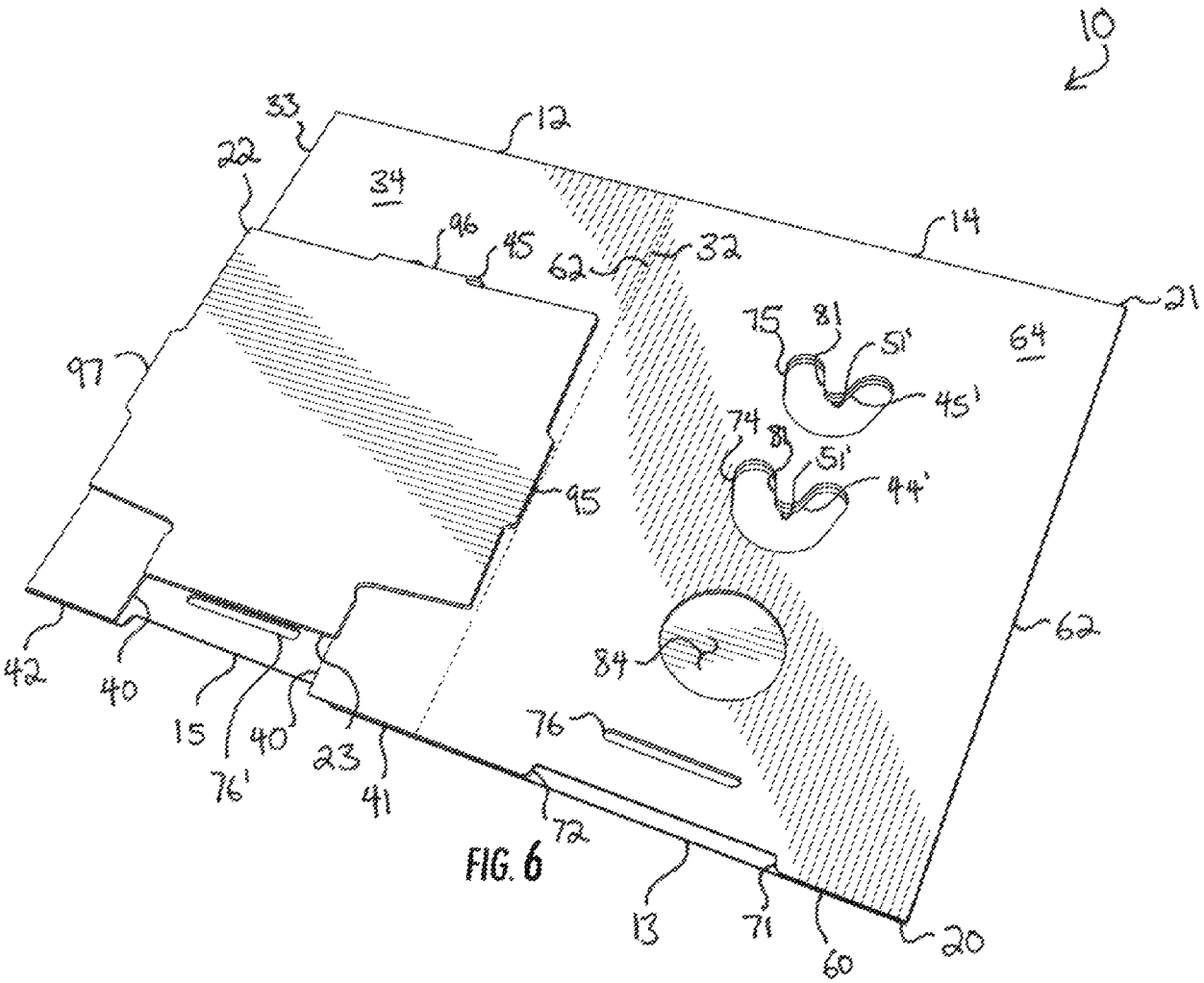
FIG. 6 is a top perspective view of the trash can of FIG. 1 arranged in a storage condition.

Turning now to FIG. 5, the receptacle 10 is constructed from a single sheet of material. FIG. 5 shows the receptacle 10 in a disassembled condition of the receptacle 10, while FIGS. 1-4 show the receptacle 10 in an assembled condition, and FIG. 6 shows the receptacle 10 in a storage condition. The disassembled condition is a collapsed condition of the receptacle 10 useful for storing the receptacle 10 for periods of non-use or for shipping so as not to occupy a large volume of space. In the disassembled condition, the front, rear, right, left, and base panels 12, 13, 14, 15, and 22 are laid flat. The base panel 22 is coupled to the front panel 22 along the living hinge 23 and extends away from the front panel 22. The right panel 14 is formed integrally to the front panel 12 along a living hinge defining a corner formed between the side edges 63 and 32 of the right and front panels 14 and 12, respectively. The side edge 62 of the right panel 14 is free of connection to another panel in the disassembled condition. The left panel 15 is formed integrally to the front panel 12 along a living hinge defining a corner formed between the side edges 62' and 33 of the left and front panels 15 and 12, respectively. The rear panel 13 is formed integrally to the left panel 15 along a living hinge defining a corner formed between the side edges 32' and 63' of the rear and left panels 13 and 15, respectively. The side edge 33' of the rear panel 13 is free of connection to another panel in the disassembled condition.

The free edges 62 and 33' of the right and rear panels 14 and 13, respectively, carry an engagement assembly 90 to couple the right and rear panels 14 and 13 when the receptacle 10 is in the assembled condition. The engagement assembly 90 consists of, on the rear panel 13, a flap 91 carried on the side edge 33' and having two spaced-apart slots 92 formed along the side edge 33', and, on the right panel 14, two tabs 93 projecting outward away from the side edge 62. The tabs 93 have enlarged heads and notches 94 that extend slightly into the right panel 14 opposite from the direction in which the tabs 93 extend. The tabs 93 are disposed vertically on the side edge 62 to correspond to the slots 92 formed between the flap 91 and the rear panel 13. In the disassembled condition of the receptacle 10, the tabs 93 are free of the flap 91 and the slots 92 formed therein, as shown in FIG. 5. In the assembled condition of the receptacle 10, as shown in FIG. 1, the tabs 93 are inserted into the slots 92, the tabs 93 are applied against the inner face 35' of the rear panel 13, and the flap 91 is applied against the inner face 64' of the left panel 15. The flap 91 fits over the notches 94 to provide a secure engagement between the tabs 93 and the slots 92 with little vertical play. Generally, this engagement assembly 90 couples the left panel 15 to the rear panel 13 to form the sidewall 11 of the receptacle 10 and provide vertical rigidity to the receptacle 10. In some instances, such as when the receptacle will not be returned to the disassembled condition, and adhesive is applied between the tabs 93 and the inner face 35' of the rear panel 13, and between the flap 91 and the inner face 64' of the left panel 15 to permanently bond the tabs 93 to the inner face 35' and the flap 91 to the inner face 64', thereby permanently coupling the rear panel 13 to the left panel 15.

Returning to FIG. 5, the base panel 22 has three projecting tabs 95, 96, and 97. These tabs 95, 96, and 97 fits into the slots 76, 46, and 76' in the right, rear, and left panels 14, 13, and 15, respectively, when the receptacle 10 is arranged in the assembled condition. The tabs 95, 96, and 97 engage with the slots 76, 46, and 76' to secure the base panel 22 with respect to the right, rear, and left panels 14, 13, and 15, and to provide rigidity to the receptacle 10. With the tabs 95, 96, and 97 engaged with the slots 76, 46, and 76', the panels 12, 13, 14, and 15 are prevented from moving or shifting with respect to each other, as the slots 76, 46, and 76' limit relative lateral movement of the base panel 22 in the sidewall 11.

FIG. 6 shows the receptacle 10 in the storage condition thereof. The receptacle 10 is arrangeable and moveable among the disassembled, assembled, and storage conditions depending on the needs of the user. The storage condition of the receptacle 10 is useful for storing the receptacle 10 for long periods of time in a slender storage space, as may be necessary in a car or RV camper. In the storage condition, the receptacle 10 is laid flat, with the front panel 12 against the left panel 15 and the right panel 14 against the rear panel 13. More specifically, the inner faces 35 and 65' of the front and left panels 12 and 15 are in juxtaposition with each other, and the inner faces 65 and 35' are in juxtaposition with each other. The base panel 22 is pivoted against the outer face 34 of the front panel 12, and the base panel 22 extends upwardly toward the top 21 of the receptacle 10. The base panel 22 is slightly narrower than the front panel 12, such that the tabs 95 and 97 are just within the side edges 32 and 33. Folded in this way, the base panel 22 extends over the front panel, with the tab 96 overlying and partially concealing the engagement 45, and overlying and concealing the engagement 44, protecting the structural features and elements of the engagements 44 and 45. In the storage condition of the receptacle 10, the engagements 75 and 45' are overlaid and the fingers 81 and 51' are overlaid, providing additional support and rigidity to the fingers 81 and 51', thus protecting the fingers 81 and 51' from deflection and damage. Similarly, although not shown, the engagements 75' and 45 are overlaid and the fingers 81' and 51 are overlaid, providing additional support and rigidity to the fingers 81' and 51, thus protecting the fingers 81' and 51 from deflection and damage.

Turning now to FIG. 4, the receptacle 10 is useful in the assembled condition thereof for holding bags to contain items such as trash. FIG. 4 illustrates a section view of the receptacle 10 with two bags applied, designated here as a lower bag 100 and an upper bag 101. The receptacle 10 is structured to be suitable for use with many more bags, but two bags 100 and 101 are shown here for clarity of the illustration. The bags 100 and 101 are nested with each other, with the upper bag 101 nesting the lower bag 100.

The bags are standard grocery bags each having bodies 100A and 101A and two handles 100B and 100C, and 101B and 101C. To arrange the bags 100 and 101 in the condition shown in FIG. 4, the lower bag 100 is applied to the interior 24 first. The body 100A of the lower bag 100 is placed over the top 21 (which forms a square opening into the interior 24) and into the interior 24 of the receptacle 10, and the handles 100B and 100C are applied to the engagements 75 and 75', respectively, to secure the lower bag 100 on the receptacle 10 so that the lower bag 100 depends from the top 21 and is suspended at an elevated position above the base panel 22, defining a void 102 between the bottom of the lower bag 100 and the base panel 22. The handles 100B and 100C are applied in the same manner, and so only the application of the handle 100B will be described. The handle 100B is taken, as by hand and passed into the hole 80 of the engagement 75. It is noted that the handle 100B is applied to the hole 80 in the engagement 75, which is the engagement above the engagement 74 which receives the handle 101B of the upper bag 101. Accordingly, the lower bags are applied to higher engagements, and higher bags are applied to lower engagements. The handle 100B is passed into the hole 80 and around the finger 81. The handle 100B encircles the finger 81, with the handle 100B applied against the inner face 65 of the finger 81 proximate to the top 82, and the handle 100B extending out of the engagement 75 through the gaps 83 on either side of the finger 81. The finger 81, as an integral and rigid extension of the sidewall 11, resists flexing in response to outward and upward forces applied by the lower bag 100 as items are loaded into the body 100A or the lower bag 100, providing a secure anchor for the handle 100B. The handle 100B extends upward along the outer face 64 of the right panel 14 to the top 21, where the body 100A of the bag is stretched around the receptacle 10 and from which the body 100A is suspended into the interior 24. In the same way, the other handle 100C is applied to the engagement 75'. With the lower bag 100 in place, the upper bag 101 is then applied. The handles 101B and 101C are applied to the engagements 74 and 74' of the receptacle 10, and the body 101A of the upper bag 101 is placed over the lower bag 100 which is stretched over and around the top 21, and the body 101A then hangs within the interior 24.

The void 102 defined below the lower bag 100 is accessible through the ports 84 and 84', which are disposed laterally proximate to the void 102 and provide direct access thereto. The void 102 is a compartment for holding spare bags. FIG. 4 illustrates one such spare bag 103 disposed on the base panel 22. Many spare bags can be stored in the void 102. A spare bag is placed in the void 102 by stuffing the spare bag through either of the ports 84 and 84', as by taking up a spare bag by hand and pushing it through either of the ports 84 and 84'. The spare bags can later be retrieved by placing a hand through either of the ports 84 and 84', grasping a spare bag, and pulling the spare bag through the port 84 or 84'. As trash or other items are placed into the upper bag 101 and become heavy in the upper bag 101, the lower bag 100 will continue to maintain separation from the base panel and will continue to define the void 102 as a sizable chamber for storing spare bags. In this way, the receptacle 10 is useful for both containing waste and storing many spare plastic bags which might otherwise contribute to clutter, litter, or landfill waste.

Still referring to FIG. 4, the receptacle rests on the ground (not pictured) with the various feet (feet 41' and 42' shown here in FIG. 4) against the ground. The base panel 22 is spaced apart from the ground, and as such moisture from the ground is not transmitted to the base panel 22 and is not transmitted into the void where the moisture may damage or weaken the spare bag 103. Likewise, moisture in the spare bag 103 is carried off by circulation of air through the ports 84 and 84', and if moisture seeps into the base panel 22 from the spare bag 103, such moisture will be carried off by air circulation under the base panel 22 between the feet 41' and 42' of the receptacle 10.

The tiered arrangement of the engagements 74 and 75, and of the engagements 74' and 75', allows many bags to be nested in the interior 24 between the right and left panels 14 and 15. The bags are nested in two levels; a lower level of bags applied to the engagement 75 (hanging generally as shown by lower bag 100), and an upper level of bags applied to the engagement 74 (hanging generally as shown by upper bag 101). In the same way, although not shown in FIG. 4, the tiered arrangement of the engagements 44 and 45, and of the engagements 44' and 45', allows many bags to be nested in the interior between the front and real panels 12 and 13. These bags are also nested in two levels.

Because the engagements 44 and 45, and 44' and 45', of the first set of opposed side panels (front and rear panels 12 and 13) are vertically offset from the engagements 74 and 75, and 74' and 75', of the second set of opposed side panels (right and left panels 14 and 15), the two levels of bags hanging from the engagements 75 and 75' and from 74 and 74' are offset from the two levels of bags hanging from the engagements 45 and 45' and from 44 and 44'. In this way, four levels of tiered bags depend from the receptacle 10. As trash fills the upper-most bag, the upper-most bag is removed and disposed of, and the next highest bag becomes the bag into which trash is placed and contained.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

1. A receptacle comprising:

a sidewall including first and second sets of opposed side panels;

first and second retention assemblies formed through the first and second sets of side panels, respectively, each of the first and second retention assemblies including a plurality of engagements;

the first retention assembly is vertically offset with respect to the second retention assembly; and a port formed through the sidewall below the retention assemblies.

2. The receptacle of claim 1, wherein:

the plurality of engagements in the first retention assembly are tiered; and the plurality of engagements in the second retention assembly are tiered.

3. The receptacle of claim 1, wherein each engagement comprises:

a hole in the sidewall; and a finger projecting into the hole.

4. The receptacle of claim 3, wherein the finger is integrally and rigidly formed with the sidewall.

5. The receptacle of claim 3, wherein the finger projects downwardly into the hole.

6. The receptacle of claim 1, wherein:

the engagements each have a width; and the port has a width equal to the width of the engagements.

7. A receptacle comprising:

a sidewall defined by opposed first and second side panels and by opposed third and fourth side panels, each extending between a top and opposed bottom of the receptacle;

a base panel disposed above the bottom of the receptacle;

tiered first and second sets of engagements formed in the opposed first and second side panels, respectively;

tiered third and fourth sets of engagements formed in the opposed third and fourth side panels, respectively;

the first, second, third, and fourth sets of engagements are spaced above the bottom of the receptacle; and a port formed through the sidewall below the engagements.

8. The receptacle according to claim 7, wherein the first and second sets of engagements are vertically offset with respect to the third and fourth sets of engagements.

9. The receptacle according to claim 7, wherein each of the engagements comprises:

a hole in the sidewall; and a finger projecting into the hole.

10. The receptacle of claim 9, wherein the finger is an integral and rigid extension of the sidewall resistant to flexing away from the sidewall.

11. The receptacle of claim 9, wherein the finger projects downwardly into the hole.

12. The receptacle of claim 9, wherein opposed gaps are formed on two sides of the finger and are each at least as wide as the finger.

13. A receptacle comprising:

a base panel;

a sidewall including first and second sets of opposed side panels, each side panel extending between a top and an opposed bottom of the receptacle;

first and second sets of engagements formed in the first and second sets of opposed side panels, respectively, and vertically offset with respect to each other;

the receptacle is arrangeable among a disassembled condition, an assembled condition, and a storage condition;

in the disassembled condition of the receptacle, the sidewall is severed between side panels, the sidewall and the base panel are flat and the base panel extends away from the sidewall;

the base panel is coupled to one of the side panels along a living hinge such that, in the assembled condition of the receptacle, the base panel is disposed above the bottom of the receptacle;

in the assembled condition of the receptacle, bags are applied to the receptacle and are suspended from the top of the receptacle, each bag having a body depending into the receptacle and having handles applied over the top of the receptacle and into one of the first and second sets of engagements formed in the first and second sets of opposed side panels, respectively; and in the storage condition of the receptacle, the sidewall is continuous, the sidewall and the base panel are flat, and the base panel is pivoted against a front face of the one of the side panels.

14. The receptacle according to claim 13, wherein each of the engagements comprises:

a hole in the sidewall; and a finger projecting into the hole.

15. The receptacle of claim 14, wherein the finger is integrally and rigidly formed with the sidewall and projects downwardly into the hole.

16. The receptacle according to claim 13, wherein:

a lower bag is suspended above the base panel, defining a void between the lower bag and the base panel configured to store spare bags between the lower bag and the base panel;

a port is formed through the sidewall below the first and second sets of engagements; and the port provides access into the void for storage of the spare bags between the lower bag and the base panel.

17. The receptacle according to claim 16, wherein:

each of the engagements comprises a hole in the sidewall having a width, and a finger integrally and rigidly formed with the sidewall which projects downwardly into the hole; and the port has a width equal to the width of the hole.

* * * * *